US005735220A

United States Patent [19]

Wang

[11] Patent Number: 5,735,220

[45] Date of Patent: Apr. 7, 1998

[54] SLIDE RAILS OF EXTENSIBLE TABLE

[76] Inventor: Ming-Cheng Wang, 1598-7, Chun Suan Rd., Shen kang Hsiang Taichung Hsien, Taiwan

[21] Appl. No.: 769,677

[22] Filed: Dec. 16, 1996

[51] Int. Cl.[6] ..... A47B 1/00

[52] U.S. Cl. ..... 108/87

[58] Field of Search ..... 108/87, 86, 83

[56] References Cited

U.S. PATENT DOCUMENTS

| | | | |
|---|---|---|---|
| 1,877,314 | 9/1932 | Herbert | 108/87 |
| 3,094,007 | 6/1963 | Luhrs | 108/87 |

*Primary Examiner*—Peter M. Cuomo
*Assistant Examiner*—Gerald A. Anderson
*Attorney, Agent, or Firm*—W. Wayne Liauh

[57] ABSTRACT

A slide rail is intended for use in an extensible table and is composed of a sliding seat and two sliding supports. The sliding seat is provided with two guide rails, two guide slots, and a gear. The sliding supports are provided respectively with a plurality of sliding wheels and a rack. The sliding supports are joined with the sliding seat such that the racks of the sliding supports are engaged with the gear of the sliding seat, and that the sliding wheels are capable of sliding along the guide rails. The stationary leaves of the extensible table are slidably fastened with the slide rails and are therefore capable of sliding in opposite directions to accommodate an extension leaf.

2 Claims, 9 Drawing Sheets

SLIDE RAILS OF EXTENSIBLE TABLE

FIELD OF THE INVENTION

The present invention relates generally to an extensible table, and more particularly to the slide rails of the extensible table.

BACKGROUND OF THE INVENTION

As shown in FIGS. 1 and 2, a prior art slide rail of an extensible table is composed of three connection rods of a wooden material. These connection rods include an intermediate connection rod 11 and two slidable connection rods 12 and 13. The intermediate connection rod 11 is provided with a gear 111 located at the center thereof and is further provided respectively on both longitudinal sides thereof with the dovetail slots 112 and 113 opposite in location to each other. The slidable connection rod 12 is provided with a rack 121, whereas the slidable connection rod 13 is provided with a rack 131. In addition, the slidable connection rods 12 and 13 are provided respectively on both longitudinal sides thereof with the dovetail blocks 122 and 132, which are engageable with the dovetail slots 112 and 113, and with the gear 111 of the intermediate connection rod 11. As the slidable connection rod 12 is moved, the gear 111 is actuated by the rack 121 such that the rack 131 is moved so as to enable the slidable connection rod 13 to be extended along the dovetail slot 113. Now referring to FIG. 3, a table top is composed of two stationary leaves 14 and 15, and an extension leaf 16. As the stationary leaf 14 is pulled, another stationary leaf 15 is actuated to move so as to form a gap located between the two stationary leaves 14 and 15 such that the extension leaf 16 can be fitted into the gap for extending the table top.

Such a prior art slide raft of the extensibe table as described above has several inherent shortcomings, which are described explicitly hereinafter.

The dovetail slots and the dovetail blocks of the connection rods of a wooden material are vulnerable to deformation caused by the changes in temperature in the environment, thereby hindering the sliding motion of the slide rail. In addition, the deformation of the connection rods can obstruct the engagement of the rack with the gear. Moreover, the production of the prior art slide rail is not cost-effective in view of the fact that the connection rods are provided respectively with the dovetail slots and the dovetail blocks.

The extension leaf of the extensible table is supported entirely by the dovetail slots and the dovetail blocks, and is therefore vulnerable to collapse at such time when the deformation of the connection rods occurs or when the extension leaf is overloaded.

The racks of the slidable connection rods are engaged with the gear of the intermediate connection rod of the prior art slide rail. As a result, the slidable connection rods of a sufficient length must be provided to facilitate the mounting of the racks at the expense of the production cost control.

SUMMARY OF THE INVENTION

It is therefore the primary objective of the present invention to provide an extensible table with a slide rail, which is composed of a sliding seat, and two sliding supports. The sliding seat is provided with two guide rails, two guide slots, and a gear. The sliding supports are provided respectively with a plurality of sliding wheels, and with a rack. The sliding supports are joined with the sliding seat such that the racks of the sliding supports are engaged with the gear, and that the sliding wheels are capable of sliding along the guide rails. The stationary leaves of an extensible table are slidably fastened with the slide rails and are therefore capable of sliding in opposite directions to accommodate an extension leaf which is located between the stationary leaves.

The foregoing objective, features, structures, functions, and advantages of the present invention will be more readily understood upon a thoughtful deliberation of the following detailed description of an embodiment of the present invention in conjunction with the accompanying drawings.

DETAILED DESCRIPTION OF THE EMBODIMENT

Figure 1:
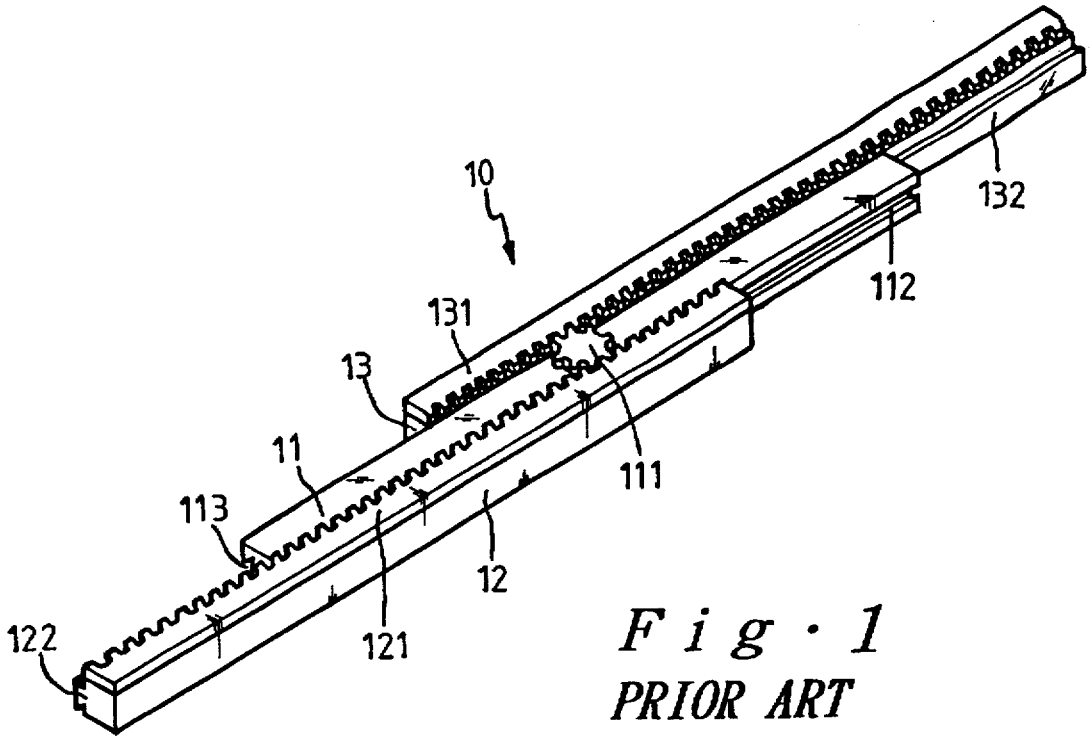
Fig. 1 PRIOR ART
FIG. 1 shows a perspective view of a prior art slide rail of the extensible table.
Figure 2:
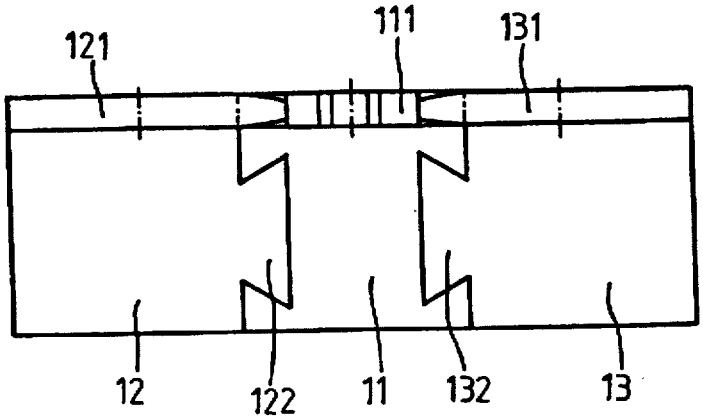
Fig. 2 PRIOR ART
FIG. 2 shows a sectional view of the prior art slide rail as shown in FIG. 1.
Figure 3:
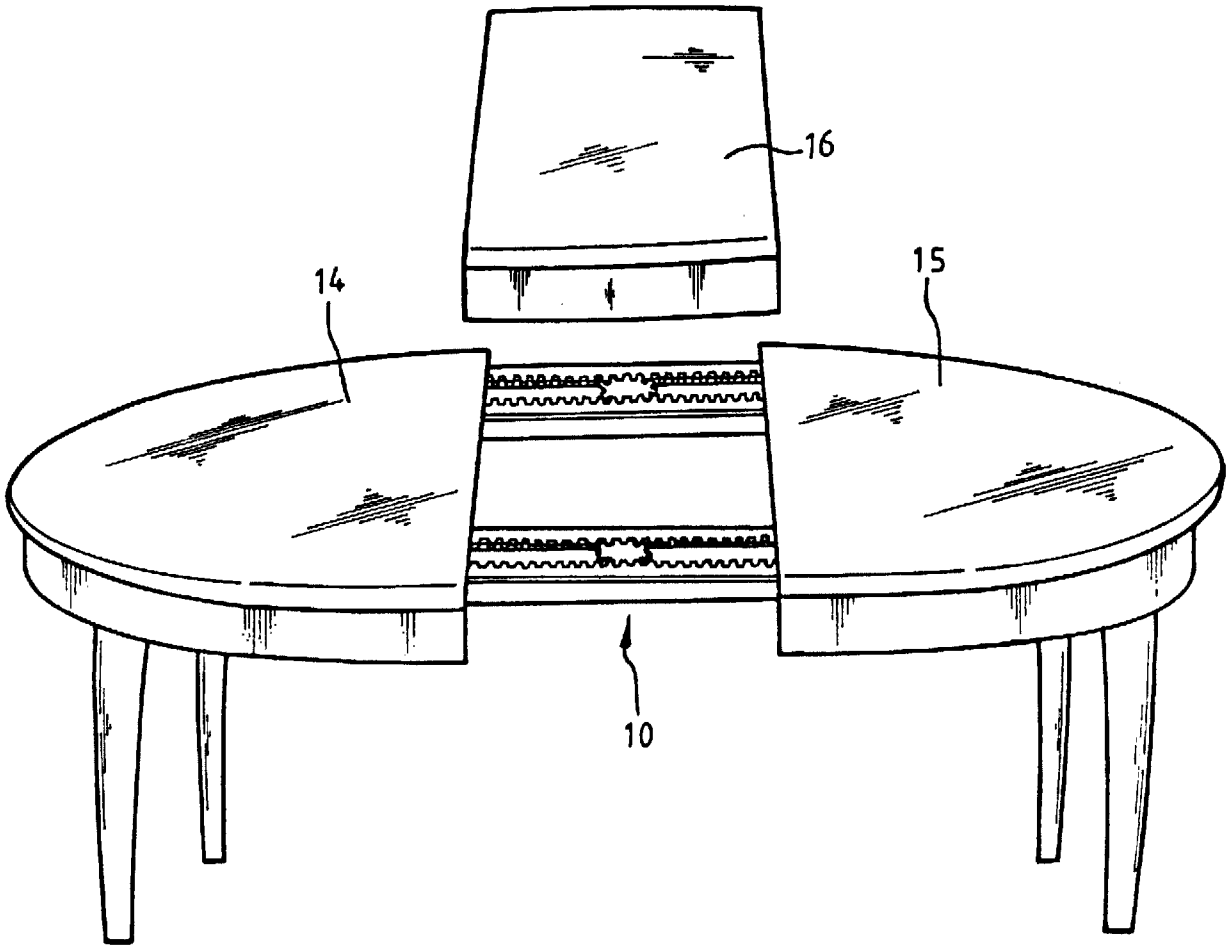
Fig. 3 PRIOR ART
FIG. 3 is a schematic view illustrating the application of the prior art slide rail.
Figure 4:
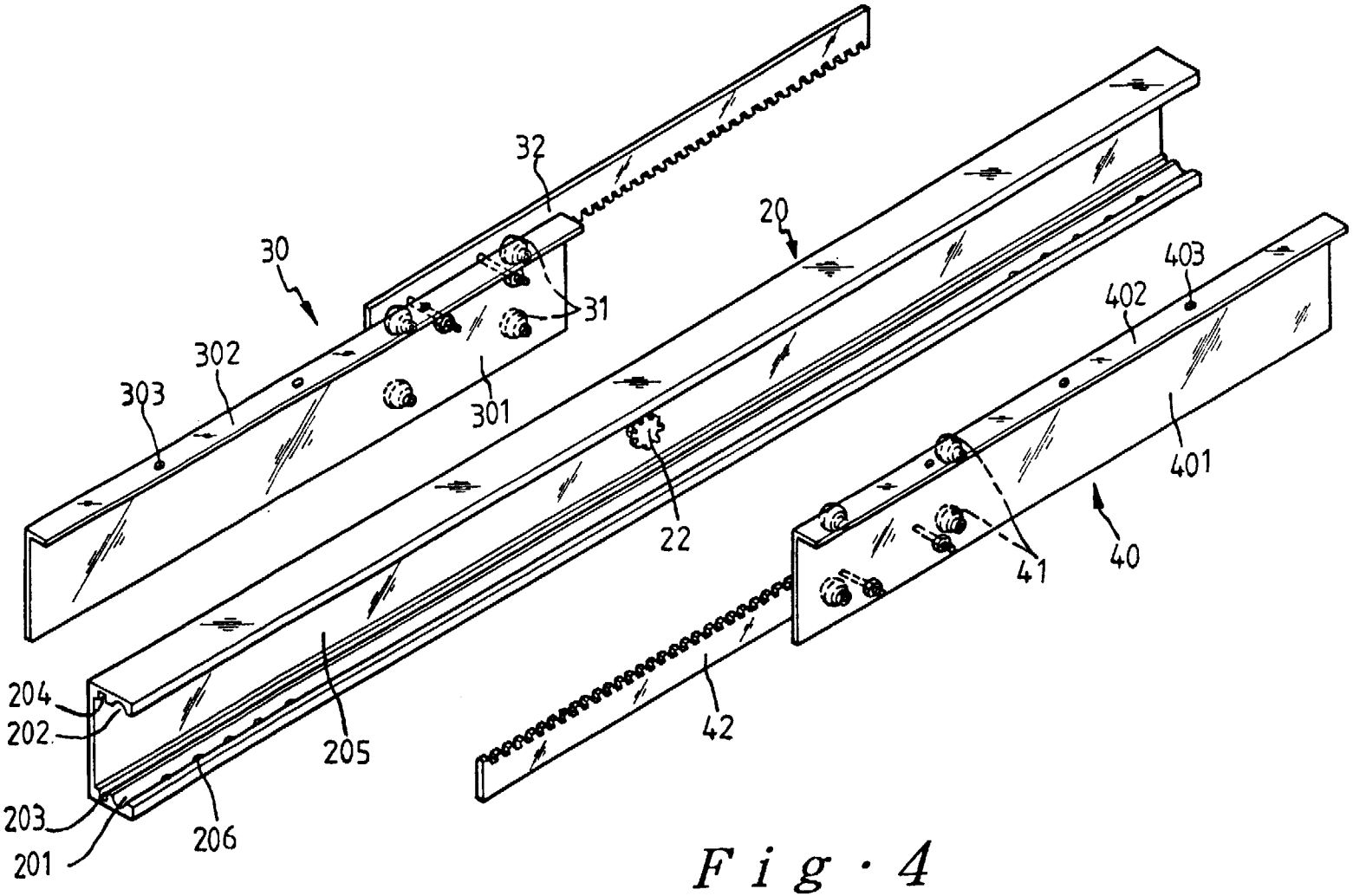
FIG. 4 shows an exploded view of a slide rail of the present invention for use in the extensible table.

As shown in FIG. 4, a slide rail of the present invention is composed of a sliding seat 20 and two sliding support 20 and 30. The sliding seat 20 has a C-shaped cross section, whereas the sliding supports 30 and 40 have an L-shaped cross section.

The sliding seat 20 is made of an aluminium material by extrusion and is provided with two guide rails 201 and 202, and with two guide slots 203 and 204. The sliding seat 20 is further provided on a side wall 205 thereof with a gear 22, and at one end thereof with a plurality of threaded holes 206 corresponding in location to the guide rail 202.

The sliding support 30 is provided on a side plate 301 thereof with a plurality of sliding wheels 31 fastened therewith, and with a rack 32 having a toothed edge which faces upwards.

The sliding support 40 is provided on a side plate 401 thereof with a plurality of sliding wheels 41 fastened therewith, and with a rack 42 having a toothed edge which faces downwards.

The sliding support 30 has a top plate 302 provided with a plurality of threaded holes 303, while the sliding support 40 has a top plate 402 provided with a plurality of threaded holes 403. The sliding supports 30 and 40 are fastened respectively with the stationary leaves of an extensible table by a plurality of bolts engageable with the threaded holes 303 and 403 of the sliding supports 30 and 40.

Figure 5:
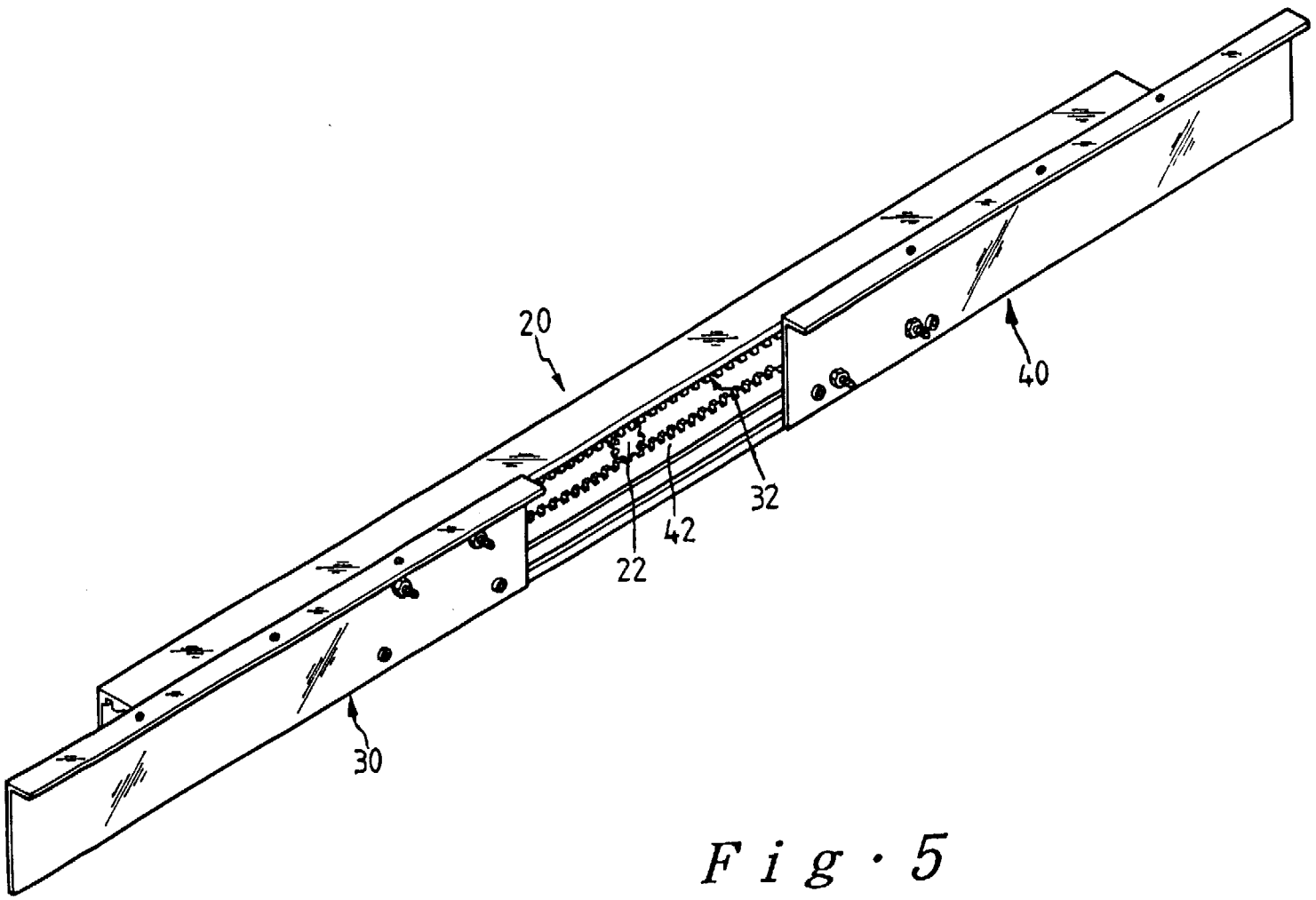
FIG. 5 shows a perspective view of the slide rail in combination according to the present invention.
Figure 6:
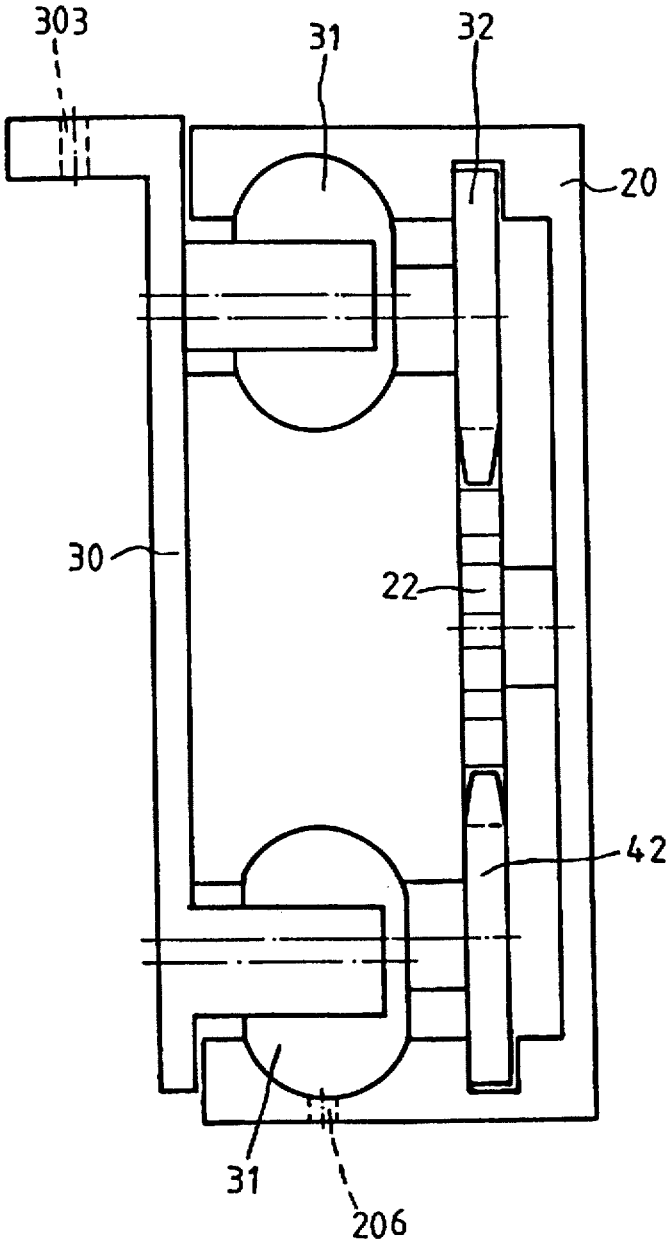
FIG. 6 shows a sectional view of the slide rail of the present invention.

As illustrated in FIGS. 4, 5 and 6, the sliding supports 30 and 40 are joined with the sliding seat 20 such that the sliding support 30 is fitted into the sliding seat 20 from one end of the sliding seat 20, and that the sliding support 40 is fitted into the sliding seat 20 from another end of the sliding seat 20, and further that the sliding wheels 31 are corresponding in location to the guide rails 201 and 202, and still further that the rack 32 is corresponding in location to the guide slot 203, and still further that the rack 42 is corresponding in location to the rack 42, and still further that the racks 32 and 42 are engaged with the gear 22 serving as a transmission means. As one of the two sliding supports 30 and 40 is pulled in one direction, another one of the two sliding supports 30 and 40 is atuated to move in another direction opposite to the direction in which the sliding support is pulled. Thereafter, the sliding supports 30 and 40 are located by a bolt 23 which is engaged with any one of the threaded holes 206 such that the bolt 23 is extended into the guide rail 202.

Figure 7:
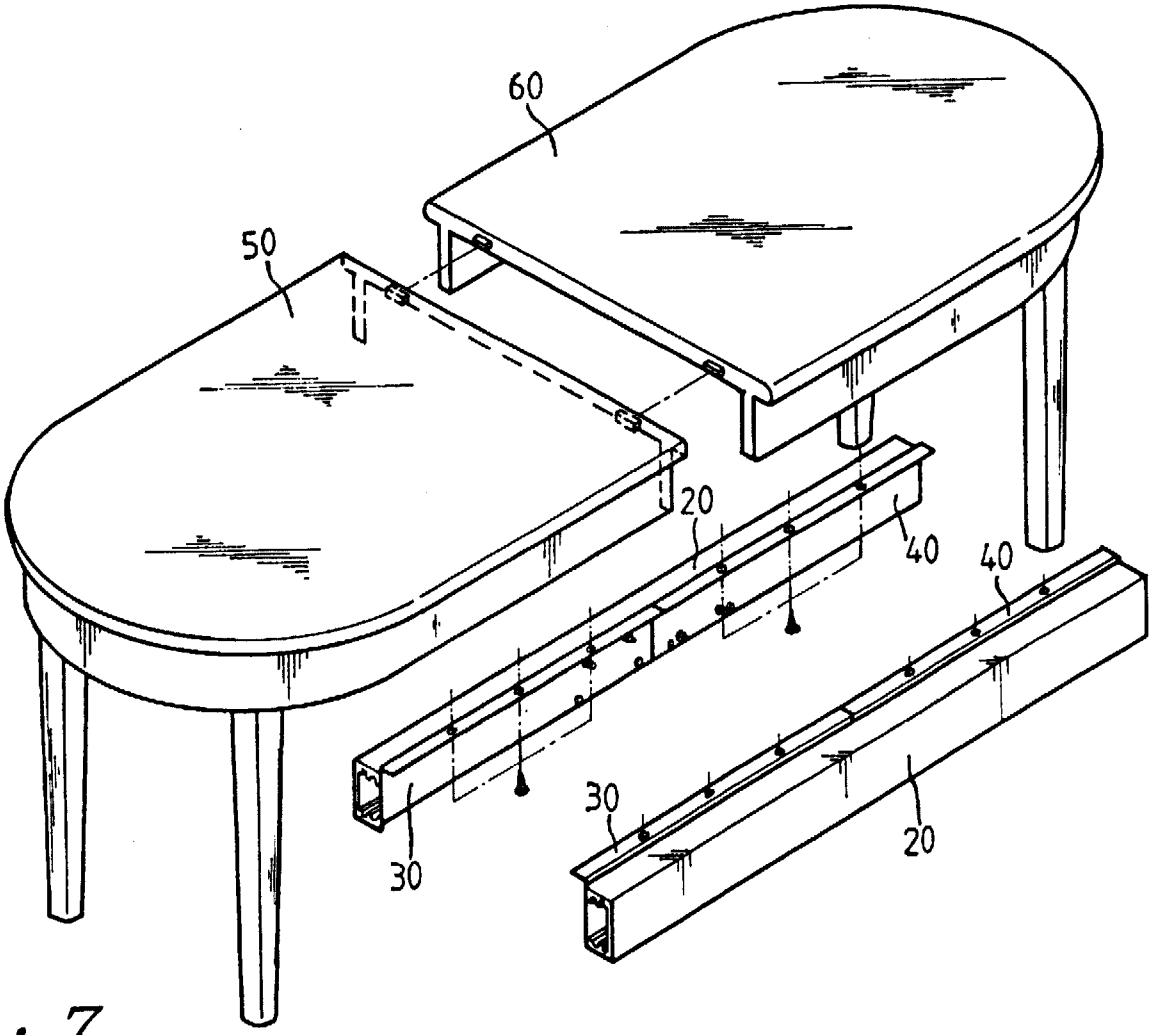
FIG. 7 is a schematic view showing the way that the slide rails of the present invention are joined with the stationary leaves of an extensible table.
Figure 8:
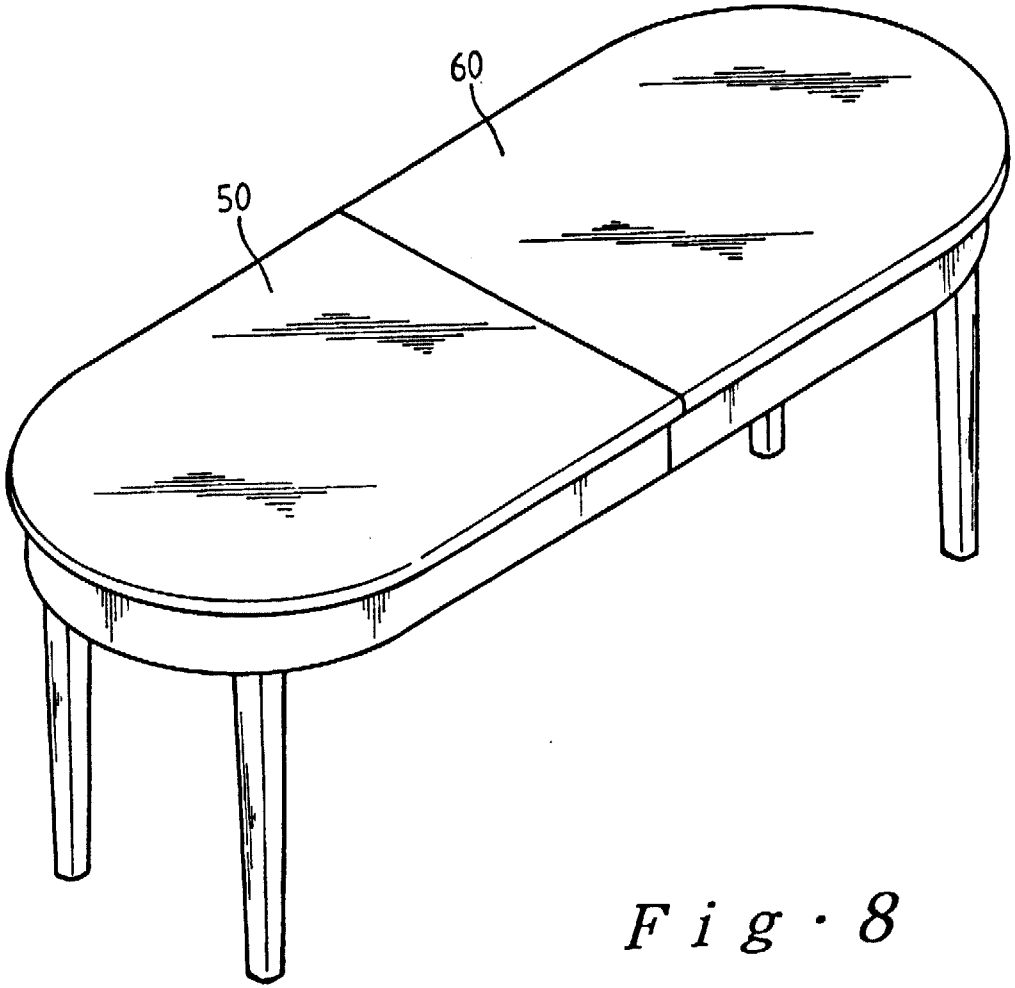
FIG. 8 shows a perspective view of an extensible table without an extension leaf.
Figure 9:
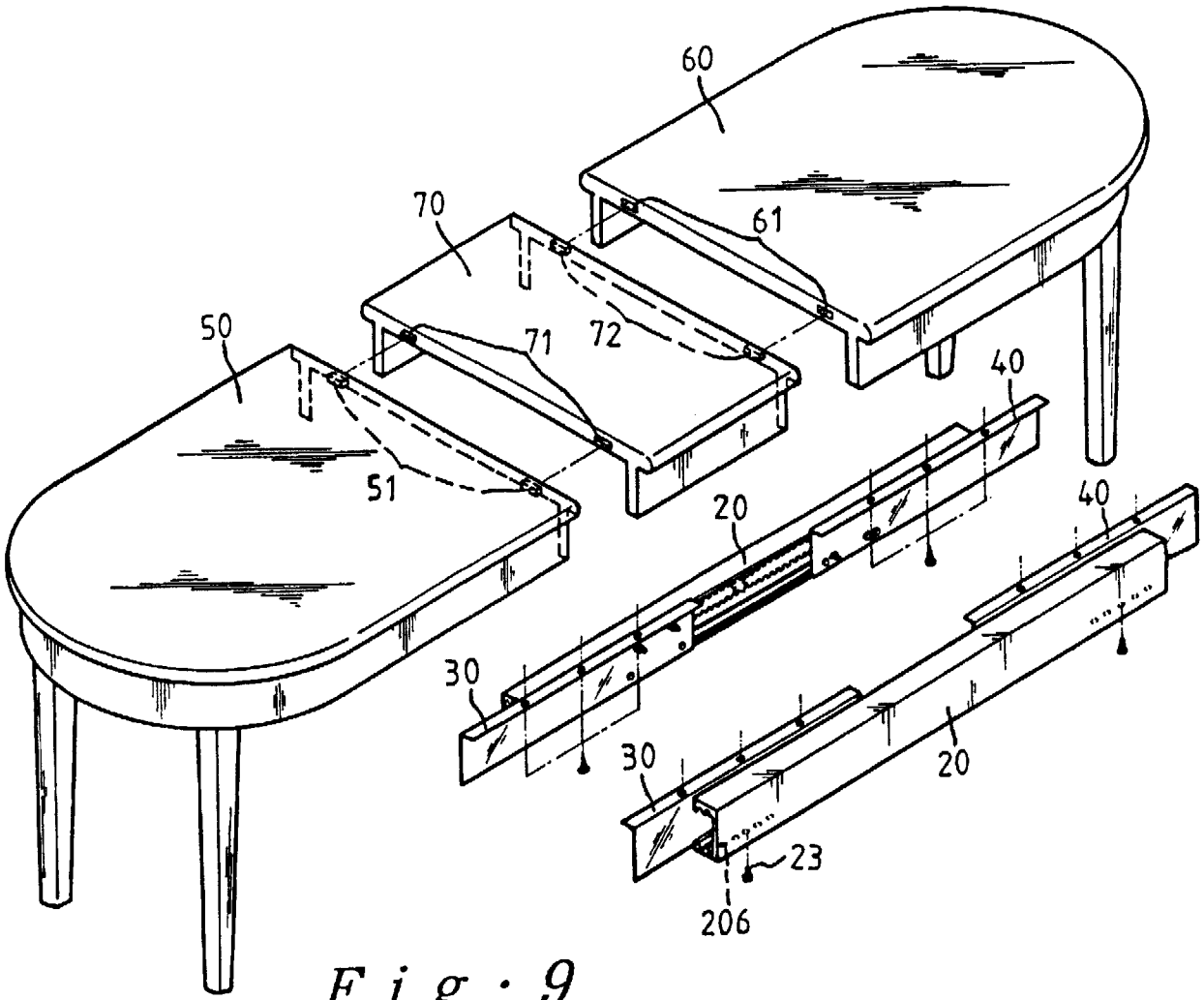
FIG. 9 is a schematic view showing the way that an extension leaf is joined with the extensible table provided with the slide rails of the present invention.
Figure 10:
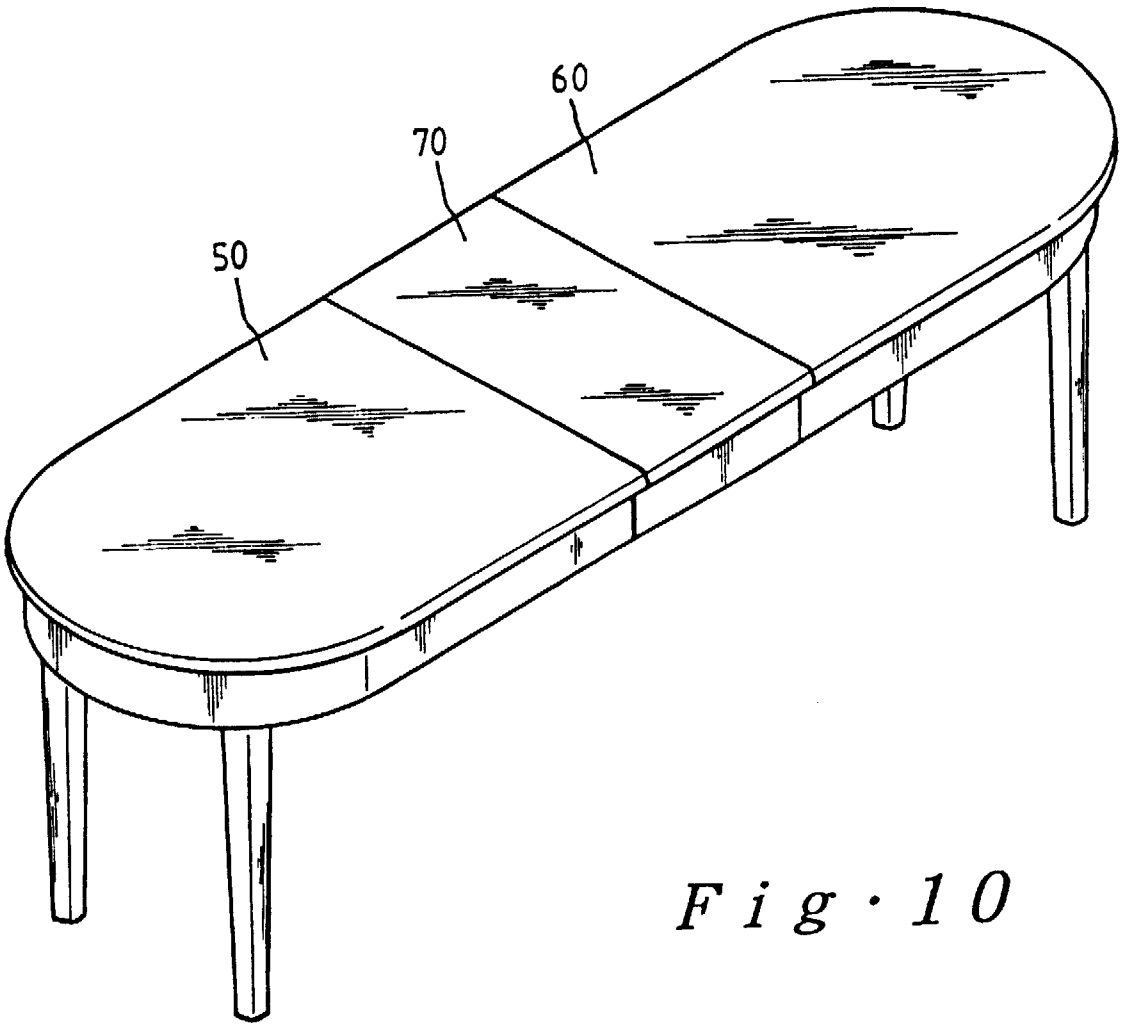
FIG. 10 shows a perspective view of the extensible table in combination according to FIG. 9.

As illustrated in FIGS. 7 and 8, the slide rails of the present invention are used to hold two stationary leaves 50 and 60 of an extensible table such that the stationary leaf 50 is slidably fastened with the top plate 302 of the sliding support 30, and that the stationary leaf 60 is slidably fastened with the sliding support 40. As the stationary leaf 50 is pulled out, the stationary leaf 60 is caused to move in the direction away from the stationary leaf 50 so as to provide an open space located between the stationary leaves 50 and 60 to accommodate an extension leaf 70, as shown in FIG. 9. The extension leaf 70 is fastened with the stationary leaves 50 and 60 such that the tenons 71 of the extension leaf 70 are engaged with the mortises 51 of the stationary leaf 50, and that the tenons 72 of the extension leaf 70 are engaged with the mortises 61 of the stationary leaf 60. As a result, the extensible table is so extended that it comprises two stationary leaves 50 and 60, and one extension leaf 70 located between the two stationary leaves 50 and 60, as shown in FIG. 10.

It must be noted here that the size of the space located between the stationary leaves 50 and 60 for accommodating the extension leaf 70 can be adjusted to fit the size of the extension leaf 70 by means of the threaded holes 206 of the sliding seat 20, which are engageable with the bolts 23.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A slide rail of an extensible table, said slide rail comprising:

a sliding seat having a C-shaped cross section, two guide rails and two guide slots, said sliding seat provided in one side wall thereof with a gear fastened therewith;

a first sliding support having an L-shaped cross section, a plurality of sliding wheels, a top plate provided with a plurality of threaded holes, and a side plate provided with a rack fastened therewith such that a toothed side of said rack faces a floor, said first sliding support fitted into said sliding seat from one end of said sliding seat such that said sliding wheels are corresponding in location to one of said two guide rails of said sliding seat, and that said rack is corresponding in location to one of said two guide slots of said sliding seat, and further that said toothed side of said rack is engaged with said gear of said sliding seat; and a second sliding support having an L-shaped cross section, a plurality of sliding wheels, a top plate provided with a plurality of threaded holes, and a side plate provided with a rack fastened therewith such that a toothed side of said rack faces a direction opposite to the floor, said second sliding support fitted into said sliding seat from another end of said sliding seat such that said sliding wheels are corresponding in location to another one of said two guide rails of said sliding seat, and that said rack is corresponding in location to another one of said two guide slots of said sliding seat, and further that said toothed side of said rack is engaged with said gear of said sliding seat.

2. The slide rail as defined in claim 1, wherein said sliding seat is provided with a plurality of threaded holes corresponding in location to said guide rails and engageable with bolts for locating said first sliding support and said second sliding support.

* * * * *